United States Patent [19]

Denison

[11] Patent Number: 4,920,772

[45] Date of Patent: May 1, 1990

[54] BICYCLE LOCK

[76] Inventor: Robert Denison, 526 E. 83rd St., New York, N.Y. 10028

[21] Appl. No.: 349,917

[22] Filed: May 9, 1989

Related U.S. Application Data

[63] Continuation of Ser. No. 188,963, May 2, 1988, abandoned.

[51] Int. Cl.[5] ..... E05B 67/06

[52] U.S. Cl. ..... 70/53; 70/56; 70/233

[58] Field of Search ..... 70/53, 233, 234, 54, 70/55, 56, 38 R, 38 A, 38 B, 38 C

[56] References Cited

U.S. PATENT DOCUMENTS

| | | | |
|---|---|---|---|
| 699,369 | 5/1902 | Cole | 70/53 |
| 1,308,458 | 7/1918 | Voight | 70/53 |
| 1,384,590 | 7/1921 | Bottone | 70/53 |
| 1,594,683 | 8/1926 | Nelson | 70/53 |

*Primary Examiner*—Robert L. Wolfe

*Attorney, Agent, or Firm*—Stephen E. Feldman

[57] ABSTRACT

A locking device for securing a bicycle to a pole, post, bar or other stanchion is provided. The lock includes a shackle, formed from a bar of metal stock bent around itself forming a pair of parallel legs connected at one end open ended at the other end. The parallel legs are bent in a U-shape to form a shackle with legs connected at one end and open at the other. A cross bar, fitted with a locking mechanism includes holes adapted to receive the two open ends of the shackle. With each end of the shackle leg slated for forming a latch slot, a double tongue sliding latch supported in the cross bar engages the latch slots for locking the cross bar to the shackle.

14 Claims, 3 Drawing Sheets

BICYCLE LOCK

This application is a continuation of application Ser. No. 07/188,963, filed May 2, 1988, now abandoned.

BACKGROUND OF THE INVENTION

1. Field of the Invention

This invention relates to locking devices and more particularly to a new and improved locking device particularly useful in securing bicycles to substantially stationary structures such as poles, bars and stanchions, for example.

2. Description of the Prior Art

Bicycles and their use throughout the world are very old and rather popular. This popularity, although initially more so in the European countries and the Asian countries, has been increasing in the United States of America over the last few decades. Along with an increasing demand for bicycles, bicycles themselves have become much more complex and much more expensive. This large increase in both demand for bicycles and the cost of bicycles has lead to a large increase in bicycle theft. Bicycle theft has lead, in turn, to an increase in bicycle security and apparatus for securing and/or making secure unattended bicycles.

Various apparatus and locking mechanisms have been attempted for making secure unattended bicycles, without much degree of success.

Some locking mechanisms were integrated into the bicycle itself so as, when locked, to lock the steering mechanism in a turned position so that the bicycle could not be driven away without unlocking the installed or integrated lock. This approach was not very successful because, a bicycle being rather light in weight could very easily be carried away while locked and the lock on the steering mechanism could be removed and/or destroyed at a later time, with minimal damage to the bicycle.

It was found that a better approach was to secure or lock the unattended bicycle to some heavy, stable fixture such as a pole, stanchion, or some fixed structure which deterred unauthorized removal or theft of an unattended bicycle. Several different apparatus, or a combination of apparatus were, and still are, popular. One combination is a chain and lock; another is a cable and lock, the cable having loops on the ends. These combinations have been used with some success to secure a bicycle to some standing, heavy object, such as a pole or even, in some cases a reasonable fair size tree. This combination when used made it virtually impossible to carry off an unattended bicycle because of the stationary nature of the object to which the bicycle was secured. However, both chains and cables were subject to being cut by bolt cutters or hacksaws or other metal cutting or burning devices and the security offered by locking chains and/or cables was effectively reduced.

In order to defend against bolt cutters another locking mechanism was developed, i.e., a large, heavy U-shaped metal shackle with heavy, metal cross locking bars. These U-shaped shackles were made sufficiently large so that the shackle, when open, may pass around a relatively large fixed pole, bar or other pole-like object and secure the frame of the bicycle to such object. A bicycle lock typical of the U-shaped shackle and cross bar type is disclosed in U.S. Pat. No. 4,155,231; issued May 22, 1979.

However, this U-shaped shackle and cross bar bicycle lock, while providing a good defense against bolt cutters and hacksaws had other shortcomings. Because the U-shaped shackle of this type of locking mechanism was made large enough to pass around a range of pole diameters it was very often possible to insert a pry bar or lever bar between the shackle and the pole around which the shackle passes and spring open the shackle by applying a levered force against the shackle and/or locking mechanism. This, in many cases, forced open the securing mechanism without causing damage to the bicycle, leading to a successful theft.

THE PRESENT INVENTION

1. Summary of the Invention

The present invention overcomes the shortcomings of the prior art bicycle locking mechanisms and provides a novel bicycle lock and securing mechanism that offers great defense against bolt cutters and hacksaws and provides large deterrent against prying the lock open without damaging the bicycle to which it is secured. This new and improved bicycle locking device provides for securing the frame and/or other part of the bicycle to a fixed pole, post, stanchion, or other fixed object, around which the lock may be passed, while rendering it difficult, if not impractical or reasonably impossible to apply a levered pressure against the shackle or locking mechanism so as to forceably open the locking mechanism, without causing severe and value decreasing damage to the bicycle as to render the bicycle virtually useless in the resale market, thereby offering a very large deterrent to theft of the bicycle.

In its preferred embodiment, as shown herein, this new and improved bicycle securing mechanism includes a U-shaped shackle formed from a bar of hard, metal stock bent on itself at its length's half point so that the distance between the inside surfaces of the bent stock is slightly larger than the outside diameter of the tube forming the frame of a bicycle. This forms an elongated U-shaped double bar having parallel legs of substantially equal length, open at one end and connected at the other end. The U-shaped double bars or legs are then bent on themselves at a point approximately half way between the connected ends and the open ends of the parallel connected bars forming a U-shaped shackle consisting of two parallel-spaced legs connected at one end of the shackle and open at the other end of the shackle. The open ends of the shackle are closed and secured by a locking mechanism with openings in register with the open ends of the shackle legs, which mechanism is key operated. The cross piece or shackle locking mechanism is fitted with a sliding locking mechanism which latches or engages slots cut in the shackle legs so as to secure the cross piece across the two shackle leg ends.

The shackle itself being open at one end and closed at the other end may, by passing its double bars over and under respectively, the tube of the frame of a bicycle, secure the bicycle via its frame, at the closed end of the double legs while the double shackle is passed around an upright pole, post, bar or other stanchion and thence to have the open leg ends straddling of its frame of the bicycle to secure the bicycle to the pole, bar or other stanchion. The cross bar locking mechanism may be slid up the shackle legs so that there is minimal play between the tub of the frame of the bicycle and the pole and between the shackle and the pole and between the shackle and the bar of the frame. Further, this new structure of bicycle lock guards against prying open the shackle without greatly damaging the frame of the bicycle or any other part of the bicycle around which the parallel legs are secured.

Objects of the Invention

Accordingly, it is an object of the invention to provide a locking device for securing a bicycle to a pole, bar, stanchion, or other upright object which incorporates the advantages of the rigid U-shaped shackle locks in resistance to bolt cutters and hacksaws and also renders it difficult or virtually impossible to apply leverage to the locking device without causing damage to the bicycle and thus making the bicycle of little or no value to a thief.

Another object is to provide a locking device particularly suited for providing security for unattended bicycles in which the shackle of the locking device is comprised of two closely spaced legs connected together at one end and openly separated at the other.

A further object is to provide a locking device specifically adapted for locking bicycles to a pole, bar or other upright in which the locking device includes two shackle legs close together so as to reduce the vulnerability of the locking device to unauthorized opening by using a levered power.

These and other objects will become apparent when reading the following detailed description of the invention with reference to the accompanying drawings in which:

DETAILED DESCRIPTION OF THE INVENTION

Figure 1:
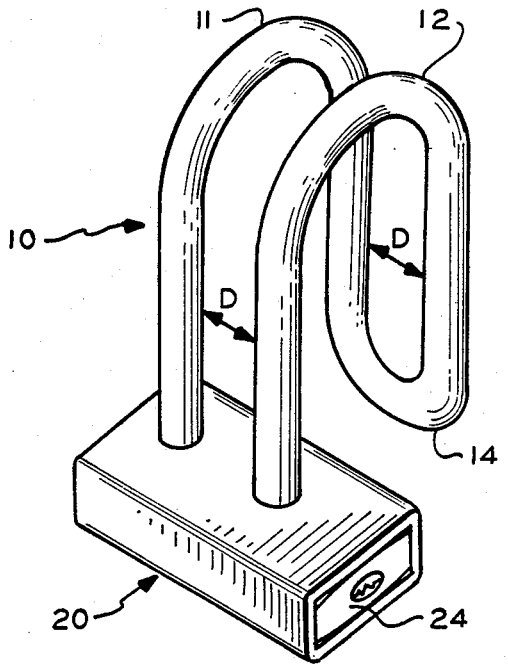
FIG. 1 is a representation, in perspective view of the invention in locked or closed condition.
Figure 2:
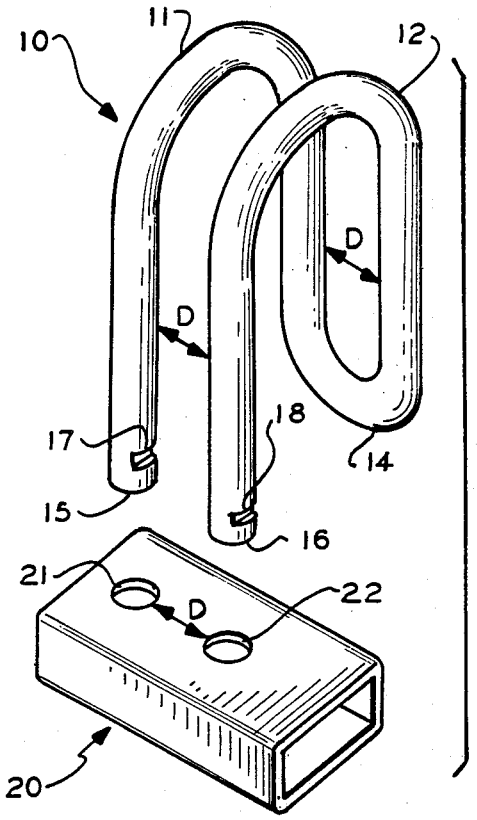
FIG. 2 is a representation of the locking device of FIG. 1 in unlocked or open condition.
Figure 3:
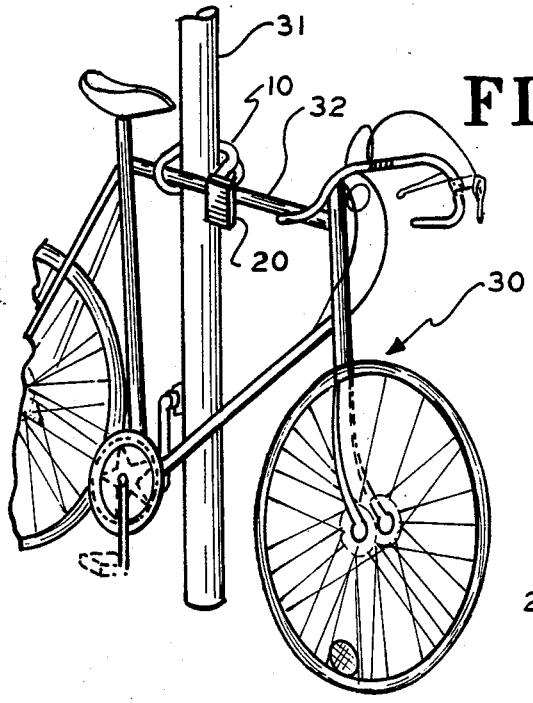
FIG. 3 is a representation of one of the uses of the invention in association with a bicycle.

Referring to FIG. 1, a preferred embodiment of the invention is represented in closed or locked condition. FIG. 2 represents the same preferred embodiment in open or unlocked condition. The locking device may, of course, be used for several purposes but the shackle is particularly constructed to secure a bicycle to a pole, post, bar stanchion or other upright or cross member for security purposes. A typical use of the invention is illustrated in FIG. 3.

In the FIGS. 1 and 2 it will be seen that the lock shackle 10 is in the form of two parallel legs 11 and 12 that are connected at their ends 14, to form an elongated open loop. Preferably the open loop is formed from metal bar stock, so that the resultant shackle is rigid and strong. Cylindrical bar stock is preferred but bar stock having other geometry may be used.

After the initial bend, at junction 14, the legs 11 and 12 are essentially in parallel relationship except at the junction 14, where the legs are connected. The distance D, between the parallel legs, is slightly more than the outside diameter of the tube making up the frame of a bicycle, such as seen in FIG. 3. It is believed that, as between bicycle manufacturers, the diameters of the tube used for forming the frame of the bicycles are within a narrow range of diameters. Thus a distance D when made for a relatively large outside diameter frame tube will fit most, if not all other bicycle frames. It has been found that a distance D of no longer than 2 inches will fit most all bicycles.

The legs 11 and 12 are open at the other ends 15 and 16 and include latching slots 17 and 18. A locking cross bar 20 has spaced holes 21 and 22 into which the ends 15 and 16 of the legs 11 and 12 fit. As seen in FIG. 1, the cross bar is fitted with a locking mechanism that is key controlled. The locking mechanism is omitted from FIG. 2 and the empty cross bar is represented. It is within the scope of the invention to reposition the key controlled mechanism so as to be on the underside of the locking mechanism. It is further anticipated that the locking mechanism may have a keyless control, such as a combination locking mechanism, for example.

FIG. 3 shows a bicycle 30 secured to a pole 31 by the locking device 10. The parallel legs 11 and 12 straddle the tube 32 of the bicycle and the junction 14 of the legs holds the bar 32 between the legs while the parallel legs shackle passes around the pole 31 and the open ended legs stradle another part of the frame tube 32. The cross bar 20 is then coupled to the shackle across the open ended legs on the far side of the frame tube 32, relative to the pole 31.

Thus, the bicycle is secured to the pole.

It can easily be seen that in order to force the cross bar 20 off the open ends of the shackle a force must be exerted on the locking mechanism that, in one way or another, will also be applied to the frame 32 of the bicycle, damaging the frame.

Figure 4A:
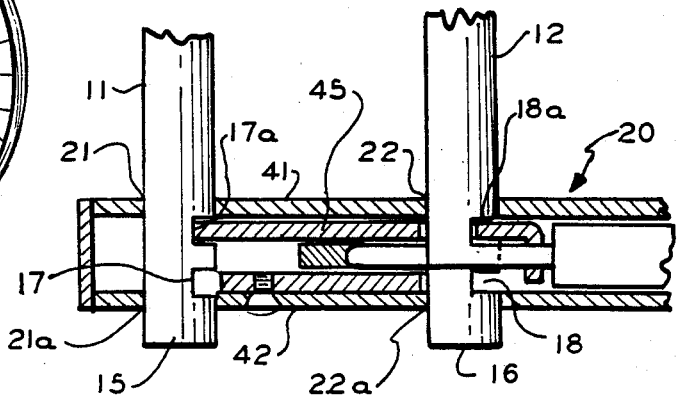
FIG. 4*a* is a cross sectional side view of the cross bar with alternate construction latching slots in the shackle.
Figure 4:
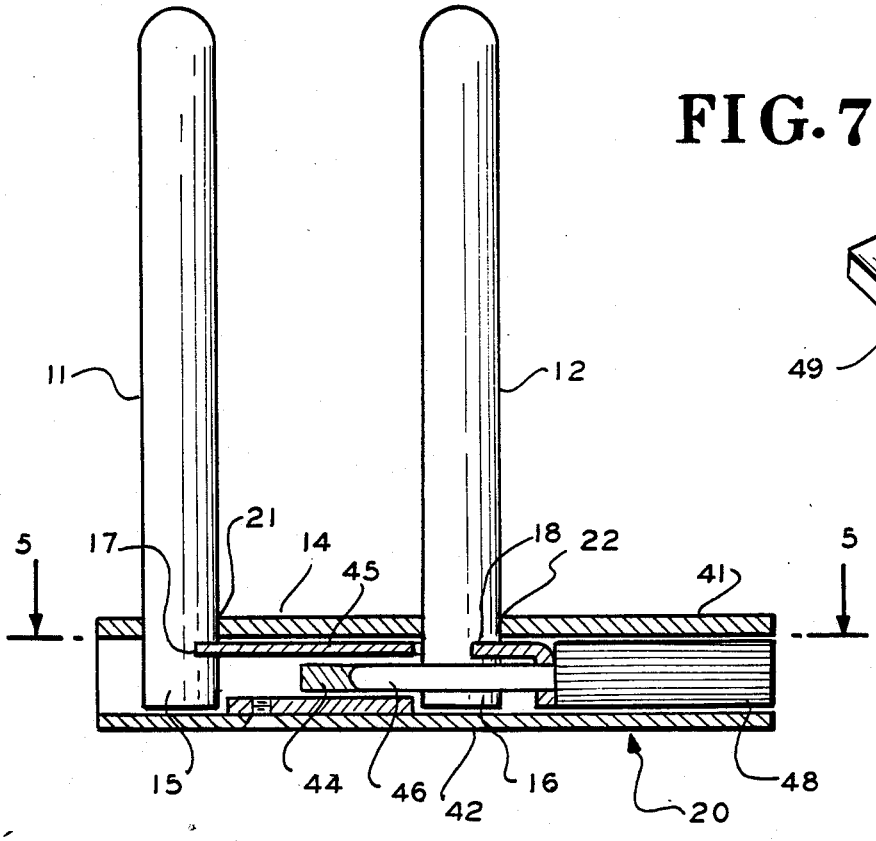
FIG. 4 is a cross sectional side view of the cross bar.

FIGS. 4 and 4*a* show sectional views of latching mechanisms that may be used in the cross bar 20. FIG. 4 shows that the shackle ends 15 and 16 and the latching slots 17 and 18 enter the holes 21 and 22, with the leg ends extending to the bottom plate 42. The latching tongues 49 and 50 on the latch plate 45, shown in FIG. 7, enter the latching slots for locking the shackle in the cross bar. The slide 46 rests against stop 44 (FIG. 6) when the locking mechanism is locked. The slide 46 couples the latching plate 45 to the key lock or tumbler, represented at 48.

In FIG. 4*a* each of the legs 11 and 12 have more than one latching slot. Although only two latching slots 17 and 17*a* for leg 11, and 18 and 18*a* for leg 12 are represented, it will be apparent that more latching slots may be added to each leg. In order to make the latching device adjustable and keep the cross bar relatively thin, holes 21*a* and 22*a* are added to the bottom plate 42, the lower holes lining up with the upper holes 21 and 22 respectively in the upper plate 41 of the cross bar 20.

Figure 6:
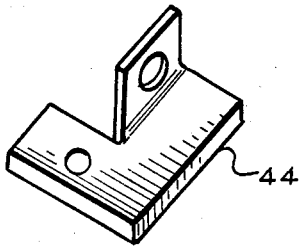
FIG. 6 is a representation of a stop used in the cross bar.
Figure 7:
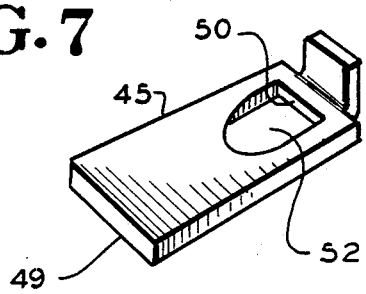
FIG. 7 is a representation of a dual latch tongue used in the cross bar.
Figure 5:
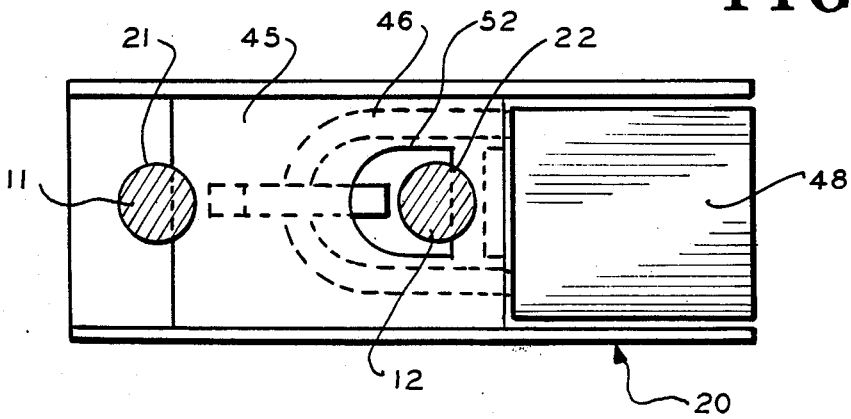
FIG. 5 is a cross sectional plan view of FIG. 4 at line 5—5.

FIG. 7 represents a dual latch latching tongue that is used to slide into a slots engaging position to lock the cross bar on to the shackle ends. The tongues 49 and 50 slide into the latching slots 17 and 18, as seen in FIGS. 4 and 5 while the slide stop 44 in FIG. 6 is used to limit the travel of the coupling 46. The dual latch latching tongue 45 has a hole 52 through which the leg end 16 may pass to position the latch slot for locking.

Figure 7A:
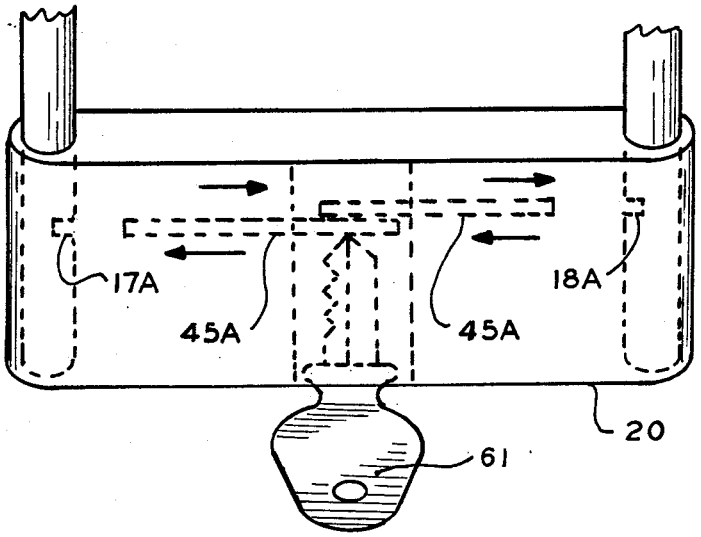

Alternatively, as shown in FIG. 7A, the cross bar may be a lock itself. In that case, latching slots 17A and 18B are positioned on the inner sides of each leg 11 and 12 and when the legs are inserted into the lock, latching tongues 45A are slid into the locking slots by rotation of a key 61, to set the lock.

Figure 8:
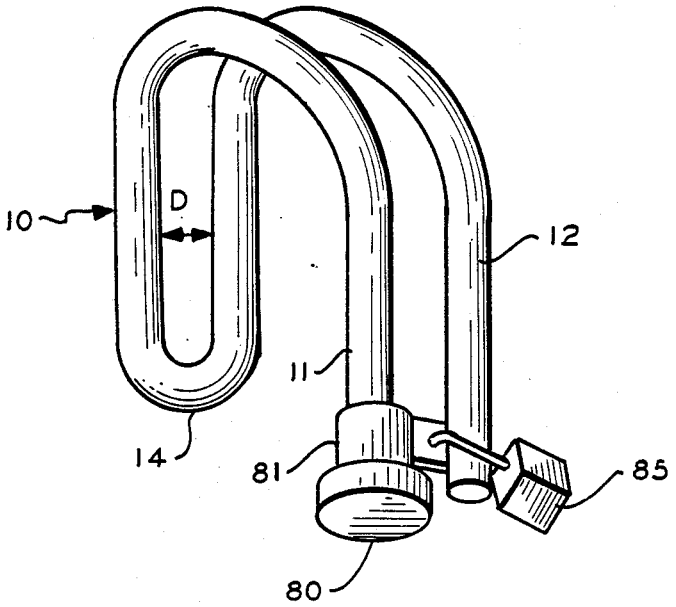
FIGS. 8 and 9 are alternate embodiments of the invention.
Figure 9:
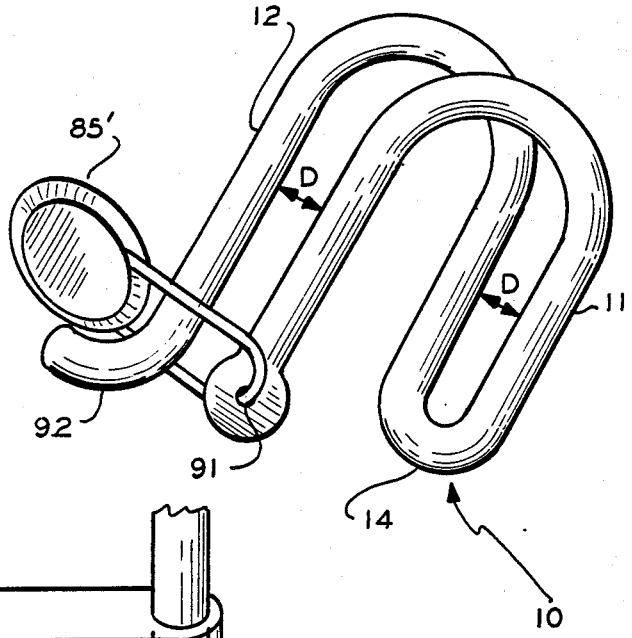

Referring to FIGS. 8 and 9, alternate structures of the invention are presented.

As with the preferred embodiment, the shackle is preferrably formed from relatively heavy metal bar stock so that, when formed, the shackle holds its structure or contour. This rigid shackle may be used with an enlargement or butt 80 at one end of the open ended legs and a locking slide 81 which fits above the butt 80. The slide may be locked across the open ended legs by a pad lock 85, thus substituting the butt end, locking slide and pad lock for the single cross bar 20, shown in the preferred embodiment.

A less complex structure is seen in FIG. 9 where one of the legs, at the open ended end is fitted with an eye 91 and the other leg has a bent foot 92. This combination may be used with a pad lock 85' to form the substitute for the single cross bar of the preferred structure.

Thus, there has been shown and described the preferred embodiment of my invention along with an alternate version for making the locking device adjustable and with alternate structures replacing the single cross bar. Variations in the key lock mechanism have also been suggested. Other changes and modifications of the structure may be made by those skilled in the art, without departing from the spirit of the invention as defined in the appended claims.

What is claimed is:

1. A lock for bicycles and the like, said lock comprising:

(a) a shackle having an open end and a closed end;

(b) a cross member adapted to lock to said shackle across the open end thereof for closing said shackle;

(c) said shackle comprising a substantially rigid serpentive bar having two ends defining its length, said bar bent over itself at approximate mid point of its said length in a first U-shape configuration having first and second single bar legs spaced from each other a first distance, a U-shape area of said first U-shape configuration defining said closed end of said shackle and said two ends of said serpentive bar defining said open end of said shackle, said first and second single bar legs bent over themselves in a second U-shape configuration having first and second double bar legs spaced from each other a distance greater than said first distance, said first double bar leg including a first part of said first single bar leg, a first part of said second single bar leg and said U-shape area, said second double bar leg including a second part of said first single bar leg, a second part of said second single bar leg and said two ends of said serpertive bar; and (d) said cross member having at least first and second holes having centerspaced from each other said first distance, said holes for receiving said two ends respectively of said serpentive bar defining said open end of said shackle for closing said shackle.

2. A lock as in claim 1 and in which said shackle further includes at least one latching slot on each leg of said first and second single bar legs, said latching slot being adjacent to the end of each leg and positioned so that said latching slot passes through the hole of said cross member in register with the leg having said latching slot when said legs are received into said cross member.

3. A lock as in claim 2 and in which said cross member further includes first and second latching tongues adapted to enter a latching slot on each leg respectively for capturing said shackle and locking said shackle in said cross member.

4. A lock as in claim 3 and in which said cross member further includes key operated means for removing said first and second latching tongues from the latching slots for releasing the legs of said shackle.

5. A lock as in claim 1 and in which said substantially rigid serpentive bar is a parallel legs are cylindrical, rigid, metal bar.

6. A lock as in claim 1 and in which said cross member has third and fourth holes, said third and fourth holes in register with said first and second holes respectively.

7. A lock as in claim 2 and in which said cross member has third and fourth holes, said third and fourth holes in register with said first and second holes respectively and each said leg of said first and second single bar legs includes at least two latching slots.

8. A lock for bicycles and the like said lock comprising:

(a) a shackle having an open end and a closed end;

(b) a cross member adapted to receive said open end of said shackle for closing said open end;

(c) said shackle comprising a first rigid bar and a second rigid bar, each bar open at its first end respectively for defining said open end of said shackle and each bar connected to each other at their second ends in a first U-shape defining said closed end of said shackle said first rigid bar and said second rigid bar separated from each other, except at the area where they are connected, a first distance, said first rigid bar and said second rigid bar bent over themselves in a second U-shape said second U-shape having a first leg and a second leg said first leg including a portion of said first rigid bar and a portion of said second rigid bar and said closed end of said shackle, said second leg including another portion of said first leg and another portion of said second leg and said open end of said shackle, said first leg and said second leg separated from each other a distance greater than said first distance; and (d) said cross member including at least first and second holes for receiving said first ends of said first rigid bar and said second rigid bar for closing said open end of said shackle.

9. A lock as in claim 8 and in which each of said bars include at least one latching slot means for receiving a latching tongue and said cross member includes at least a latching tongue means adapted for entering said latching slot means for securing said shackle in said cross member.

10. A lock as in claim 9 and said cross member further includes a lock control mechanism adapted to selectively move said latching tongue means into and out of said latching slot means for locking and unlocking said lock.

11. A lock as in claim 8 and in which said first rigid bar and said second rigid bar when connected at their respective second ends form a serpentive shackle.

12. A lock as in claim 8 and in which said first rigid bar and said second rigid bar are each cylindrical, metal bars.

13. A lock as in claim 8 and in which said shackle further includes at least one latching slot on said first rigid bar and on said second rigid bar, each said latching slot being adjacent said open end and positioned so that each said latching slot passes through said first and second holes in said cross member when said first rigid bar and said second rigid bar are received in said first and second holes of said cross member.

14. A lock for securing the frame of a bicycle to a standing post or stanchion or the like, said lock comprising:

(a) a shackle including a first U-shape configuration having an open end and a closed end formed by two single parallel legs separated from each other substantially along their lengths respectively a first distance for bracketing at least a portion of said frame between said two single parallel legs, a second U-shape configuration having an open end and a closed end said last mentioned open end formed by said first mentioned open end and said first mentioned closed end, said second U-shaped configuration formed by two double parallel legs separated substantially along their length a distance greater than said first distance for bracketing at last a portion of said post or stanchion for securing a non-parallel, juxapositional relationship between said frame and said post or stanchion; and (b) locking means connectable to said shackle across said first mentioned open end for closing said first mentioned open end for maintaining said juxapositional, non-parallel relationship between said frame of said bicycle and said post or stanchion.

* * * * *